US007197789B2

(12) United States Patent
Emmert

(10) Patent No.: US 7,197,789 B2
(45) Date of Patent: Apr. 3, 2007

(54) ROTATING AND OSCILLATING BEATER BAR ASSEMBLY FOR VACUUM CLEANERS

(76) Inventor: Emery Emmert, 387 Hill Ct., Lexington, KY (US) 40503

( * ) Notice: Subject to any disclaimer, the term of this patent is extended or adjusted under 35 U.S.C. 154(b) by 519 days.

(21) Appl. No.: 10/772,494

(22) Filed: Feb. 5, 2004

(65) Prior Publication Data

US 2004/0158953 A1 Aug. 19, 2004

Related U.S. Application Data

(60) Provisional application No. 60/447,067, filed on Feb. 12, 2003.

(51) Int. Cl.
*A47L 9/04* (2006.01)

(52) U.S. Cl. ..... 15/392; 15/389; 15/382; 15/364

(58) Field of Classification Search ..... 15/389, 15/392, 364, 380, 366
See application file for complete search history.

(56) References Cited

U.S. PATENT DOCUMENTS 2,008,972 A * 7/1935 Taylor ..... 15/363
3,204,281 A * 9/1965 Walter et al. ..... 15/364
4,209,873 A * 7/1980 Schaefer ..... 15/366
5,249,328 A * 10/1993 Shin ..... 15/366
6,189,180 B1 * 2/2001 Hato et al. ..... 15/380
6,463,623 B2 * 10/2002 Ahn et al. ..... 15/389
6,757,934 B2 * 7/2004 Park ..... 15/389
6,772,476 B2 * 8/2004 Park ..... 15/389
6,785,933 B2 * 9/2004 Kim et al. ..... 15/364

FOREIGN PATENT DOCUMENTS

GB 2206278 * 1/1989

* cited by examiner

*Primary Examiner*—Theresa T. Snider
(74) *Attorney, Agent, or Firm*—Stockwell & Smedley, PSC

(57) ABSTRACT

A beater bar assembly for use within a vacuum cleaner is disclosed. The beater bar assembly is capable of both axial oscillation (horizontal motion) and axial rotation, thereby providing an efficient cleaning motion.

23 Claims, 7 Drawing Sheets

ROTATING AND OSCILLATING BEATER BAR ASSEMBLY FOR VACUUM CLEANERS

CROSS-REFERENCE TO RELATED APPLICATIONS

This application claims priority to the earlier-filed Provisional Application No. 60/447,067, filed on Feb. 12, 2003.

FIELD OF THE INVENTION

The present invention relates to a vacuum cleaner structure, and more particularly to a vacuum cleaner beater bar assembly that is capable of both axial oscillation (horizontal motion) and axial rotation to provide an efficient cleaning motion.

BACKGROUND OF THE INVENTION

Vacuum cleaner beater bars are well known in the art. FIG. 1 shows a vacuum cleaner with a conventional beater bar assembly, as seen from underneath. The beater bar 10 improves the efficiency with which the vacuum cleaner collects dust and dirt, particularly upon the cleaning of carpets. As seen in FIG. 1, the beater bar assembly comprises a rotatable cylindrical beater bar 10 being rotatably mounted to the housing 12 of the vacuum cleaner. A drive motor 14 mounted on the base at a back position is spaced apart from the beater bar 10, and generates power for rotating the beater bar 10. A belt 18 is disposed between the beater bar structure 10 and the drive motor 14 so that driving power is transmitted from the drive motor 14 to the beater bar 10.

The rotating beater bar 10 of the prior art can be provided with helical brush strips 20 and rigid beater projections 22, both adapted for agitating the surface being cleaned such as a carpet, for improved removal of dirt therefrom. Because drive power is transmitted from the drive motor 14 to the beater bar 10, this allows the helical brush strips 20 and rigid beater projections 22 to agitate the surface being cleaned, such as a carpet or the like. However, a disadvantage of such a convention beater bar is that the motion of the beater bar is limited solely to rotary motion. Greater cleaning efficiency would be provided by a beater bar that agitated the cleaning surface through both axial oscillation (horizontal motion) and rotation of the beater bar. Consequently, a beater bar that both rotates and oscillates is desired.

BRIEF SUMMARY OF THE INVENTION

This invention has as its primary objective a vacuum cleaner beater bar assembly that agitates a cleaning surface through both axial oscillation (horizontal motion) and rotation of the beater bar. Specifically, it is an object of the present invention to provide a beater bar assembly for use within a vacuum cleaner having a cylindrical beater bar; first and second holding mechanisms for attaching the beater bar to a housing of the vacuum cleaner wherein the beater bar is rotatable within said holding mechanisms.

It is also an object of the present invention to provide the first and second holding elements to each further have a means for securing the beater bar such as an inner and outer sleeve wherein each inner sleeve is fixedly attached to the beater bar and each outer sleeve is fixedly attached to the first and second holding elements such that the distal end of the outer sleeve is attached to a medial surface of each holding element. Such a securing means permits both axial oscillation (horizontal motion) and axial rotation of the inner sleeves within the fixed outer sleeves.

These and other objects and advantages of the invention will become readily apparent as the following description is read in conjunction with the accompanying drawings.

DETAILED DESCRIPTION OF THE PREFERRED EMBODIMENTS

Figure 1:
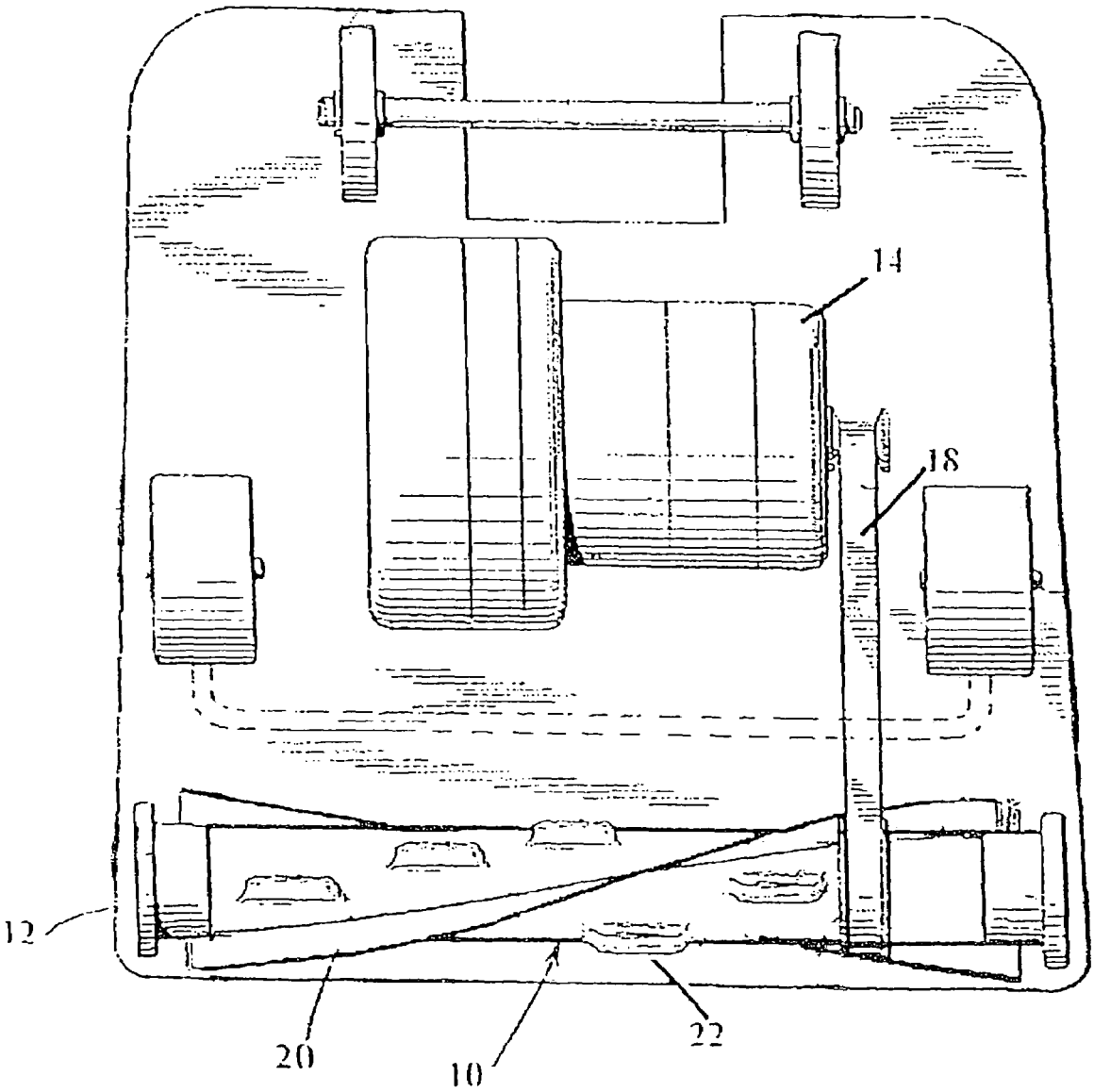
Fig. 1 PRIOR ART
FIG. 1 shows a bottom view of a beater bar assembly of the prior art.
Figure 2A:
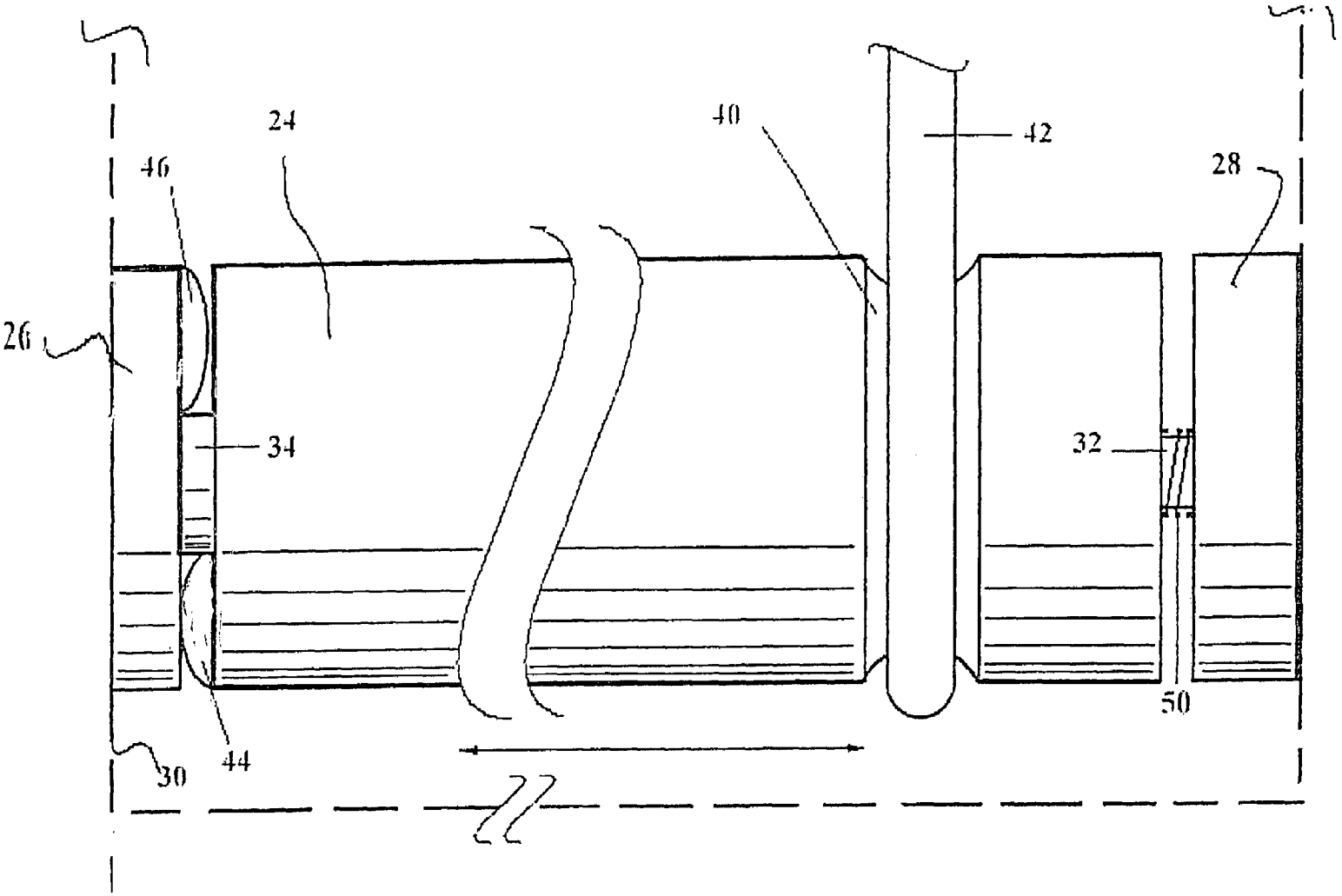
FIG. 2A shows a side view of the beater bar assembly of the present invention with a cam disengaged from a projection.

Referring now to FIG. 2A, therein is illustrated a bottom view of the beater bar assembly for a vacuum cleaner, in accordance with the preferred embodiment of the invention. In all cases, the elements of the beater bar assembly may be fabricated from materials well known and conventionally used in the prior art.

The beater bar assembly includes a beater bar 24 which may have at least one or more helical brush strips and/or rigid beater projections (not shown). The beater bar assembly further comprises a first holding element 26 and a second holding element 28 at the two ends of the beater bar 24. The holding elements 26, 28 are adapted to be held in a substantially fixed position in a housing of the vacuum cleaner. The beater bar 24 is rotatably attached at each end to the first and second holding elements 26 and 28.

Figure 4:
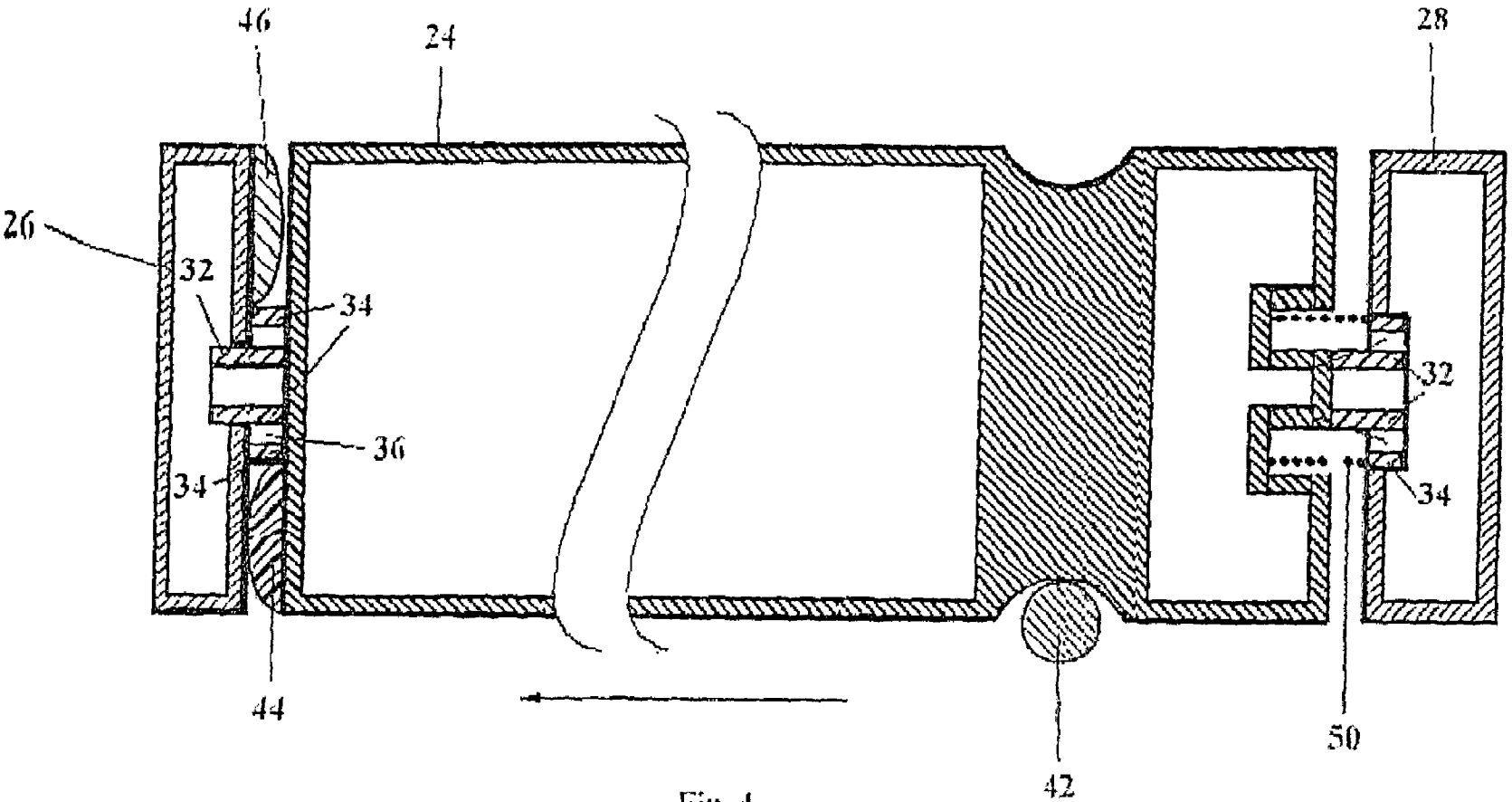
FIG. 4 shows a cross-sectional view of the beater bar assembly of the present invention.

FIG. 4 represents a cross section of the beater bar assembly shown in FIG. 2, wherein the first and second holding elements 26 and 28 further comprise bearings comprising an inner sleeve 32 and an outer sleeve 34, wherein each inner sleeve 32 is fixedly attached to the beater bar 24. Meanwhile, each outer sleeve 34 is fixedly attached to the first and second holding elements 26 and 28. The outer sleeves 34 are also attached to the first holding element 26 such that the distal end of the outer sleeve 34 is attached to medial surface of first holding element 26. With regards to the second holding element 28, the outer sleeve 34 is attached such that its medial end is flush with the medial surface of the second holding element 28.

In a preferred embodiment, the bearings are further comprised of a nylon intermediate ring 36, which permits both axial oscillation (horizontal motion) and axial rotation of the inner sleeves 32 within the fixed outer sleeves 34. However, it will be apparent that other means of permitting axial movement and rotation are known in the art and may be substituted without falling outside the scope of the present invention. By way of further example, other suitable bearings may be selected from the list comprising roller bearings, deep groove ball bearing/linear ball bearing combinations, alignment needle roller bearings with an extended inner ring, combinations of needle roller and spherical plain bearings, multi-row ball bearings, and single row ball bearings with suitably modified cage guidance.

Returning to FIG. 2A, the beater bar 24 may also be provided with an annular recess 40 which is adapted to engage a drive belt 42 in order to enable rotation of the beater bar. Preferably, the drive belt 42 is a round belt rather than flat belt that engages the annular 40 recess of the beater bar and a drive motor. The drive belt 42 translates force from the drive motor into rotation of the beater bar 24. While this driving technique constitutes the preferred driving technique for an assembly in accordance with the invention, it will be apparent that other techniques, such as the provision of a driving pulley mounted at the end or spaced from the end of the beater bar 24 may alternately be employed.

The beater bar 24 may further be provided with a cam 44 protruding from one planar surface of the beater bar 24 and proximal to the first holding element 26. The cam 44 may be tapered in shape. The first holding element 26 can further comprise a tapered projection 46 adjacent to the outer sleeve 34 of the bearing for engaging the cam 44 of the beater bar 34. The beater bar 24 is rotated such that the cam 44 engages the projection 46.

Figure 2B:
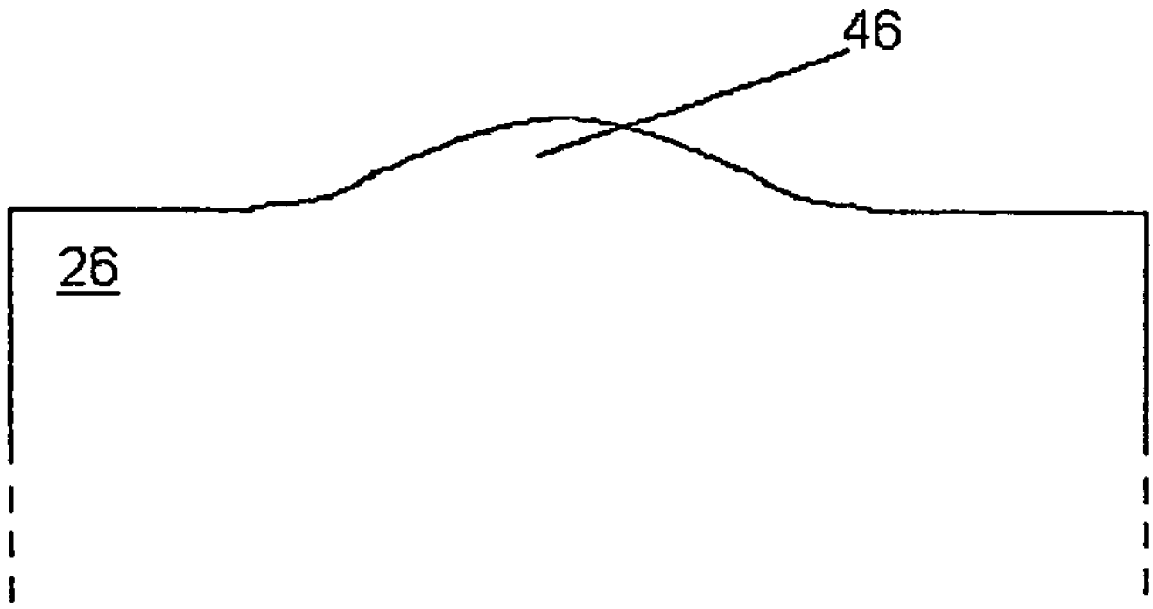
FIG. 2B shows a top view of the projection of FIG. 2A.

Specific details of the tapering of the projection 46 are shown in FIG. 2B. Because of the tapered shape of the projection 46 and the cam 44, the engagement and disengagement of the cam 44 and projection 46 occurs gradually with rotation of the beater bar 24.

Figure 3A:
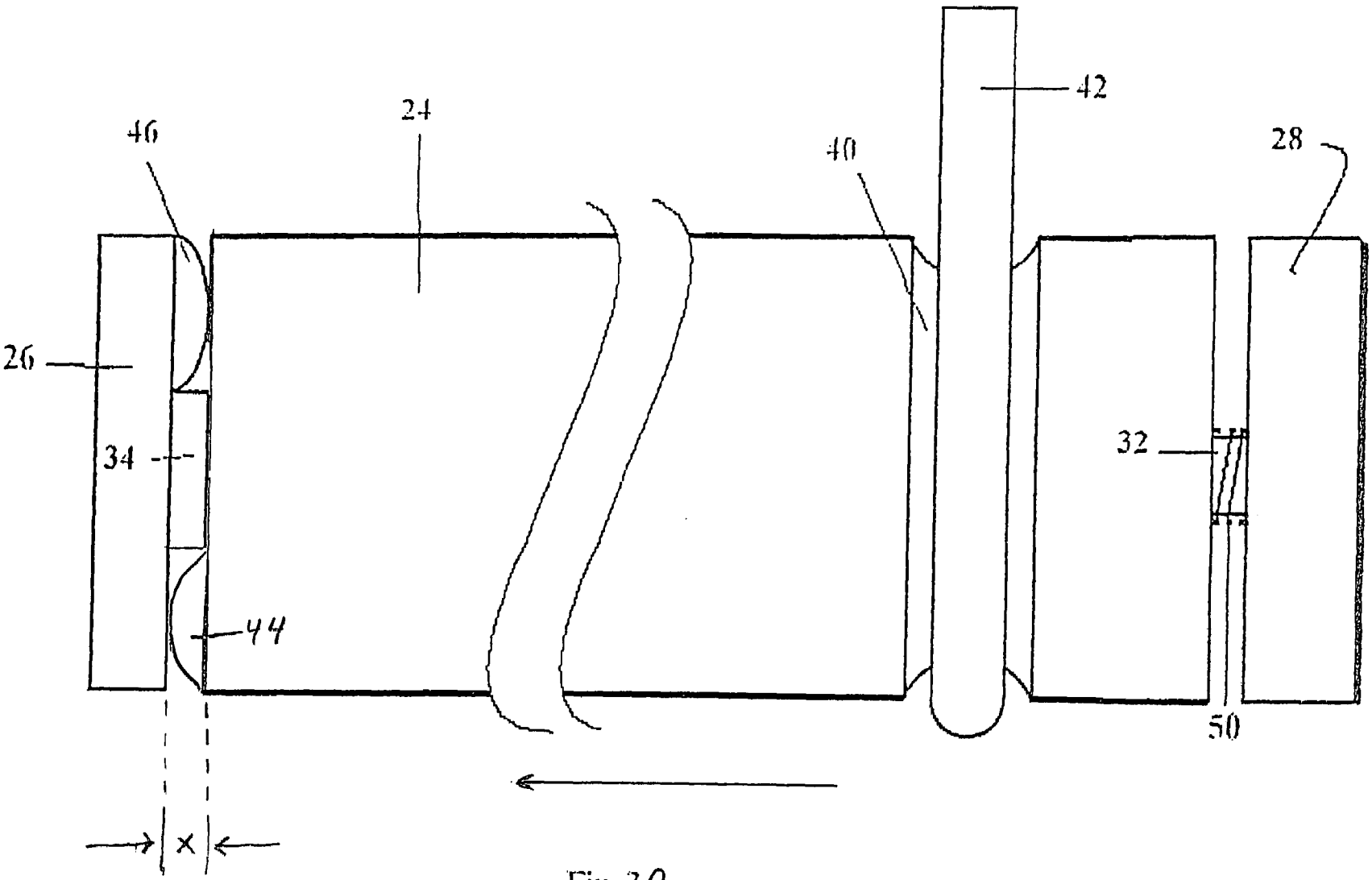
FIG. 3A shows a bottom view of the beater bar assembly of the present invention with the cam engaged.
Figure 3B:
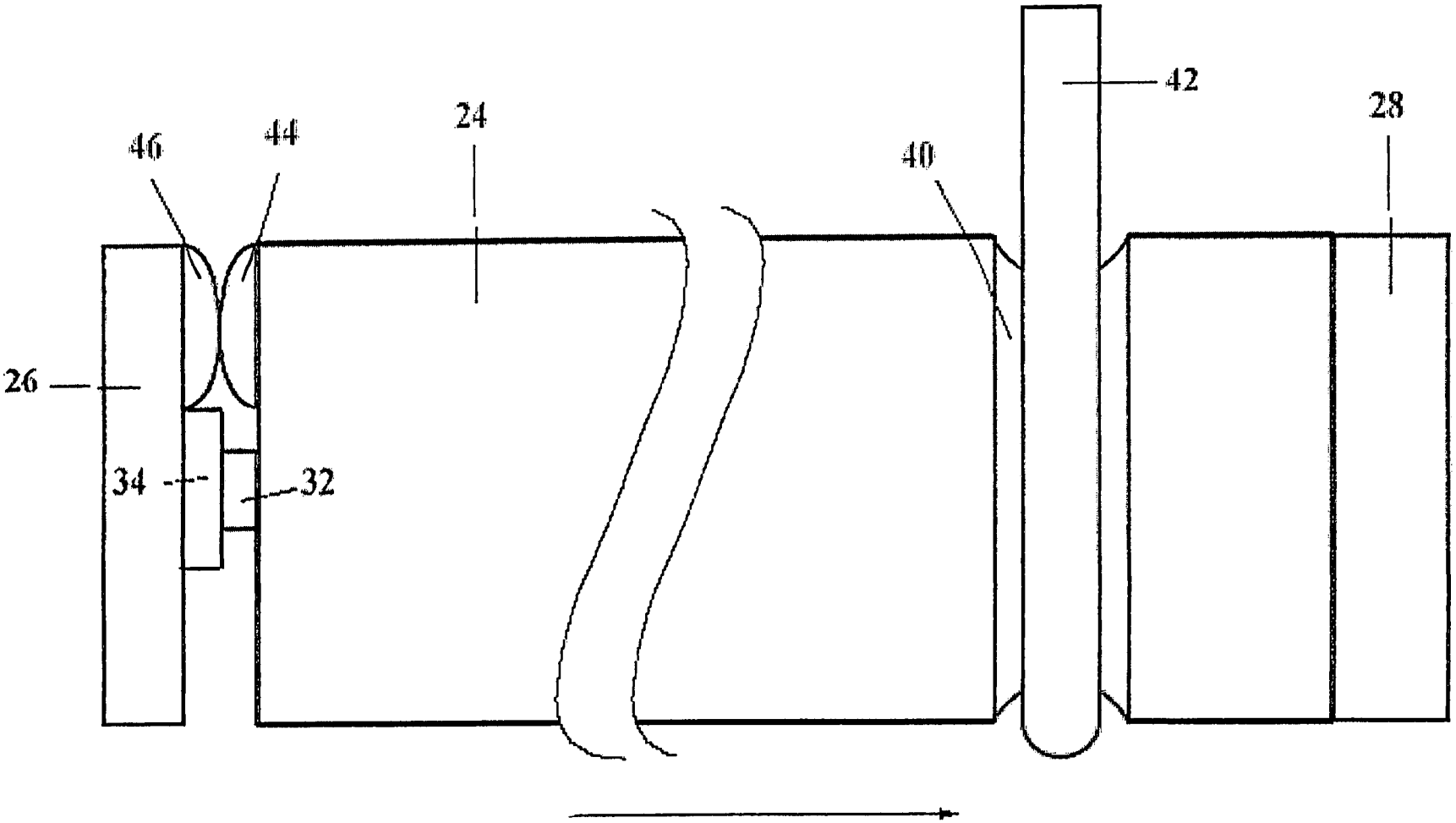
FIG. 3B shows a bottom view of the beater bar assembly of the present invention with the cam engaged.

As illustrated in FIGS. 3A and 3B, rotation of the beater bar 24 causes the cam 44 to engage and disengage the projection 46 within the first holding element 26. The engagement of the cam 44 during rotation of the beater bar 24 creates an axial force, resulting in axial displacement of the beater bar 24. FIG. 2A shows the beater bar assembly in the position the cam 44 and projection 46 are not engaged. A coiled compression spring 50 is placed around the inner sleeve 32 between the second holding element 28 and the beater bar 24. Although a coiled compression spring 50 is shown, a leaf spring could also be used.

FIG. 4 shows the coiled compression spring 50 extending into a recess of the beater bar 24. The coiled compression spring 50 is relaxed when the cam 44 is not engaged with the projection 46. Rotation of the beater bar 24 engages the cam 44 and the projection 46. The engagement of the cam 44 and projection 46 creates an axial force displacing the beater bar 24 in the direction of the second holding element 28, thus compressing the coiled compression spring 50.

FIG. 3A shows the beater bar assembly with the cam 44 and projection 46 disengaged. While this is the case, the coiled compression spring 50 is fully extended. From FIG. 3A it is apparent that the beater bar 24 is offset from the first holding element 26 by a distance of X.

FIG. 3B shows the beater bar assembly with the cam 44 and projection 46 engaged. While this is the case, the coiled compression spring 50 is fully compressed, placing an axial force on the beater bar 24 in the direction of the first holding element 26. From FIG. 3B it is apparent that the beater bar 24 is now offset from the first holding element 26 by a distance of 2X.

Further rotation of the beater bar will result in disengagement of the cam 44 from the projection 46, resulting in axial displacement of the beater bar 24, returning the beater bar assembly to the configuration of FIG. 2. In this manner, the cyclical engagement and disengagement of the cam 44 and projection 46 caused by continued rotation of the beater bar 24 generates axial oscillation (horizontal motion) of the beater bar 24.

Figure 5:
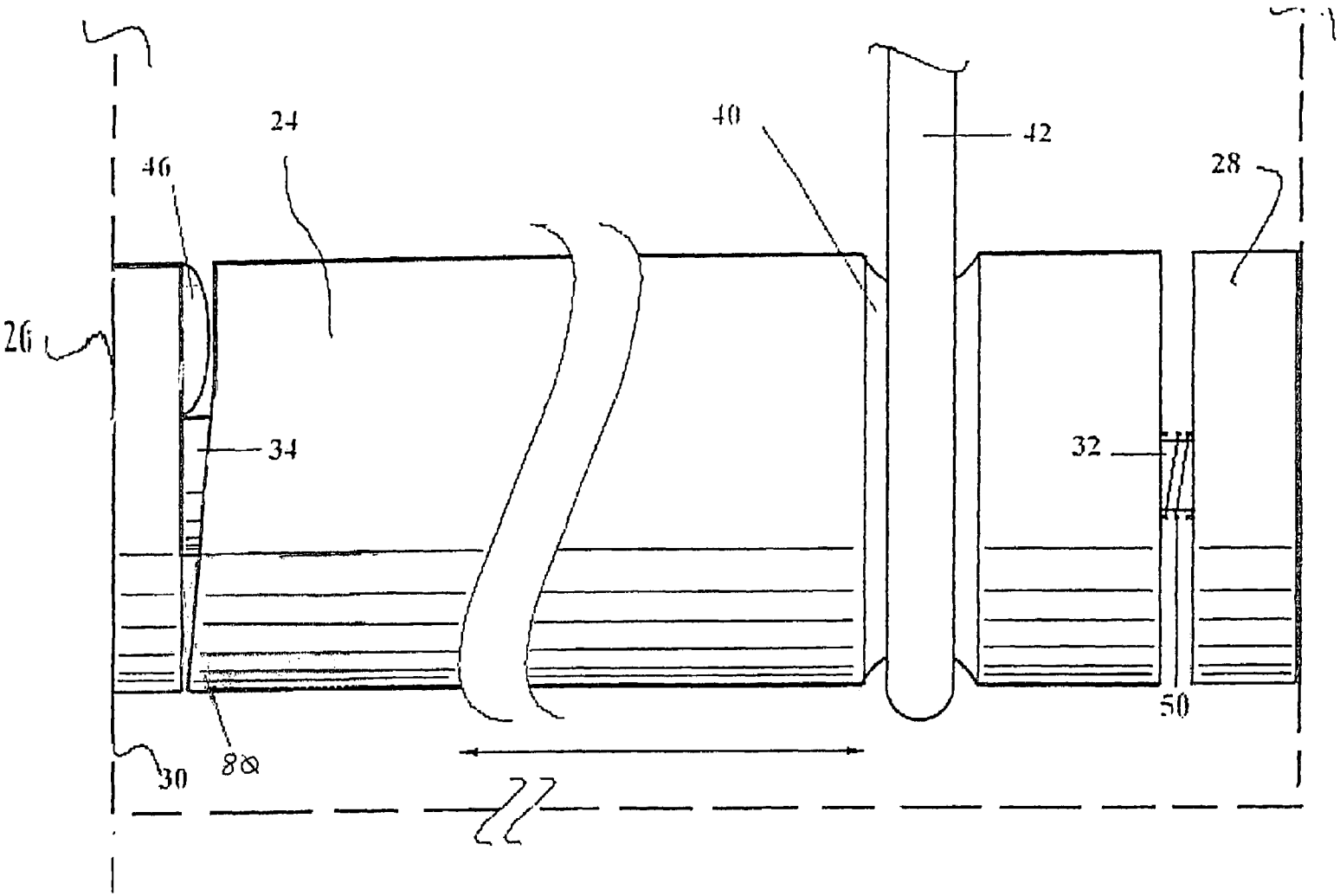
FIG. 5 shows an alternative embodiment of the projection of FIGS. 2A and 2B.

While this technique for translating rotation of a beater bar into axial oscillation (horizontal motion) constitutes the preferred technique for an assembly in accordance with the invention, it will be apparent that other techniques will also fall within the scope of the present invention. For example, as shown in FIG. 5, an assembly capable of axial oscillation (horizontal motion) can be created without a cam by angling the planar surface of the beater bar cylinder 24 so that it is no longer perpendicular to the axis of the beater bar, thereby forming a bevel 80. Rotation of the beater bar 24 would then result in axial oscillation (horizontal motion) through the periodic engagement/disengagement of the bevel 80 with the cam 44.

Alternatively, the distance between the first holder 26 and the beater bar 24 can be reduced while the projection 46 is replaced by a recess, such that the cam 44 sinks into and emerges from that recess upon rotation of the beater bar 24. By way of further example, the projection 46 may be of any shape or configuration that allows alternating engagement and disengagement that corresponds with rotation of the beater bar 24. In yet another embodiment, the projection 46 may be movable or removable such that the user may optionally prevent axial oscillation (horizontal motion) of the beater bar by removing the possibility of engagement of the projection 46 and the cam 44. Such removal can be done through a variety of user-accessible mechanisms, including but not limited to a locking pin, a solenoid, or a spring-activated switch.

As described above, the beater bar assembly in accordance with the present invention provides both axial oscillation (horizontal motion) and rotation of the beater bar, imparting greater cleaning efficiency to vacuum cleaners in which such assemblies are incorporated.

It is anticipated that various changes may be made in the arrangement and operation of the system of the present invention without departing from the spirit and scope of the invention, as defined by the following claims.

What is claimed is:

1. A beater bar assembly for use within a vacuum cleaner, comprising:

a cylindrical beater bar; first and second holding mechanisms for attaching said beater bar to a housing of said vacuum cleaner, wherein said beater bar is rotatable within said holding mechanisms;

said first and second holding mechanisms each further comprising bearings, comprising an inner and outer sleeve, wherein each inner sleeve is fixedly attached to said beater bar and each outer sleeve is fixedly attached to said first and second holding mechanisms such that the distal end of the outer sleeve is attached to a medial surface of each holding mechanism; wherein said bearings permit both axial oscillation and axial rotation of the inner sleeves within the fixed outer sleeves.

2. The assembly of claim 1, wherein said bearings further comprise a nylon intermediate ring.

3. The assembly of claim 1, wherein said bearings further comprise roller bearings.

4. The assembly of claim 1, wherein said bearings further comprise deep groove ball bearing/linear ball bearing combinations.

5. The assembly of claim 1, wherein said bearings further comprise alignment needle roller bearings with an extended inner ring.

6. The assembly of claim 1, wherein said bearings further comprise combinations of needle roller and spherical plain bearings.

7. The assembly of claim 1, wherein said bearings further comprise multi-row ball bearings.

8. The assembly of claim 1, wherein said bearings further comprise single row ball bearings with suitably modified cage guidance.

9. The assembly of claim 1, wherein said beater bar further comprises an annular recess adapted to engage a drive belt in order to enable rotation of said beater bar.

10. The assembly of claim 1, wherein said beater bar further comprises a cam protruding from a planar surface of said beater bar and proximal to said first holding mechanism.

11. The assembly of claim 10, wherein said beater bar further comprises a projection adjacent to said outer sleeve of said bearing, for engagement and disengagement with said cam.

12. The assembly of claim 11, wherein a spring is located around said inner sleeve between said second holding mechanism and said beater bar, so that a cyclical engagement and disengagement of said cam and rounded projection caused by continued rotation of said beater bar generates axial oscillation of said beater bar.

13. The assembly of claim 12, wherein said beater bar is provided with helical brush strips and rigid projections.

14. The assembly of claim 12, wherein the spring is a coiled compression spring.

15. The assembly of claim 12, wherein the spring is a leaf spring.

16. The assembly of claim 11, wherein said projection is movable or removable such that a user may optionally prevent axial oscillation (horizontal motion) of the beater bar by removing the possibility of engagement of said projection and said cam through a disengagement mechanism.

17. The assembly of claim 16, wherein said disengagement mechanism is a locking pin.

18. The assembly of claim 16, wherein said disengagement mechanism is a solenoid.

19. The assembly of claim 16, wherein said disengagement mechanism is a spring-activated switch.

20. The assembly of claim 1, wherein said beater bar is provided with helical brush strips and rigid projections.

21. The assembly of claim 1, wherein a planar surface of said beater bar is formed to have a bevel which is not perpendicular to the axis of said beater bar.

22. The assembly of claim 1, wherein said beater bar is rotated by a motor attached to said beater bar via a flat belt.

23. The assembly of claim 1, wherein said beater bar is rotated by a motor attached to said beater bar via a rounded belt.

* * * * *